United States Patent [19]

Hsie et al.

[11] Patent Number: 4,776,787

[45] Date of Patent: Oct. 11, 1988

[54] KEROSENE GASIFYING AND COMBUSTING APPARATUS

[76] Inventors: Ching-Hai Hsie, No. 26, Lane 168, Wu-Chia-I Rd.; Shih-Bao Liaw, No. 33, Lane 43, Yu-Tsun Street, Fu-Hsing Li, both of Feng-San City, Kaohsiung Hsien, Taiwan

[21] Appl. No.: 41,544

[22] Filed: Apr. 22, 1987

[51] Int. Cl.[4] ..... F23D 11/44

[52] U.S. Cl. ..... 431/208; 431/243

[58] Field of Search ..... 431/208, 243

[56] References Cited

U.S. PATENT DOCUMENTS

| | | | |
|---|---|---|---|
| 2,630,168 | 3/1953 | Farrell | 431/208 |
| 3,847,534 | 11/1974 | Nomaguchi et al. | 431/243 X |
| 4,302,180 | 11/1981 | Le Mer | 431/208 X |

FOREIGN PATENT DOCUMENTS

| | | | |
|---|---|---|---|
| 950334 | 2/1964 | United Kingdom | 431/208 |
| 2108649 | 5/1983 | United Kingdom | 431/208 |

*Primary Examiner*—Margaret A. Focarino
*Attorney, Agent, or Firm*—Holman & Stern

[57] ABSTRACT

A kerosene gasifying and combusting apparatus includes a separable structure combined with a gasifying device and a combusting device. The gasifying device includes: a gasifying body with a spraying opening and a plurality of air vents in the middle, and a positioning trough defined by an internal side wall and an external side wall of the gasifying body; a resistance preheating pipe and an oil gasifying pipe superimposedly disposed in the trough and respectively to a kerosene supply source and power source; and an oil sprayer provided under the bottom of the gasifying body through a plurality of bracing struts and communicatively connected to the oil gasifying pipe. The combusting device having a combustor body combined with a reflection cover and a concentrating radiation cover is scarfingly coupled with the gasifying device so that effective gasification and combustion kerosene are acheived therewith.

6 Claims, 3 Drawing Sheets

KEROSENE GASIFYING AND COMBUSTING APPARATUS

BACKGROUND OF THE INVENTION

This invention relates to a kerosene gasifying and combusting apparatus, particularly to a separable type of kerosene gasifying and combusting apparatus comprised of a gasifying device and a combustion device.

The structure of a conventional kerosene combustor, as shown in FIG. 1, usually includes: a gasifying disk 11; an oil-gas jet passage 12 vertically provided in a central portion of the gasifying disk 11; a gasifying case 13 welded over the gasifying disk 11 around the oil-gas passage 12 with a gasifying chamber 131 defined between the gasifying disk 11 and the gasifying case 13 and communicating with an oil inlet pile 81 and an oil-gas outlet duct 82 separately arranged in the kerosene combustor 1; a thermal resistance pre-heating pipe 14 welded to a bottom side of the gasifying disk 11; and an oil sprayer 9 disposed below the oil-gas jet passage 12 in conjunction with the gasifying disk 11 and in communication with the oil-gas outlet duct 82. When the oil sprayer 9 is actuated, the gasified kerosene in a lower portion of the combustor 1 can be sprayed into an upper portion thereof and ignited 7 by an ignitor for combustion. The defects of the known kerosene combustors are as follows:

1. High rate of trouble—as shown in FIG. 1, the gasifying case 13 is welded onto the gasifying disk 11 with a gasifying chamber 131 defined therein. In other words, the gasifying part and the combustion part of the traditional kerosene combustor 1 are combined together through a welding operation. However, as there exists a material difference between the gasifying part and the combustion part, as well as a large welded joint therebetween, breakage of the welded joint and deformation of the gasifying disk 11 can easily occur as a result of drastic temperature change between combustion and non-combustion and of the volume expansion of the oil gas within the gasifying chamber 131. The rupture of the welded joint will cause the kerosene not completely gasified therein to ooze out and combust locally in the kerosene combustor, and waste of fuel and air pollution in the room are therefore incurred therewith. In addition, the average time of rupture occurrence in the welded joint of the known kerosene combustors is about 3–6 months, and it is difficult to have it repaired.

2. Inefficiency of gasification—since the thermal resistance pre-heating pipe 14 is also welded to the bottom side of the gasifying disk 11 for preheating and gasifying the kerosene before combustion, the indirect preheating arrangement is inefficient because it takes a longer time to effect preheating and gasifying the kerosene. Therefore, it is inconvenient in operation and also wastes too much electrical power.

SUMMARY OF THE INVENTION

It is accordingly a primary object of this invention to provide a separable type of kerosene gasifying and combusting apparatus that overcomes the foregoing defects associated with the prior art.

According to the present invention, this and other objects are achieved by providing a separable type of kerosene gasifying and combusting apparatus, which comprises a separable structure consisting of a gasifying device and a combustion device in combination. The gasifying device includes a gasifying body structure made of material with good thermal conductivity, having a spraying opening formed in a center portion with a plurality of air vents evenly located in a flange surface defining the spraying opening; an internal side wall vertically formed along the outer periphery of the flange surface; and an external side wall with a lower flange and an open section spacingly located along the periphery of the internal side wall with a positioning through defined between the two side walls. An oil gasifying pipe and a resistance oil preheating pipe are superimposedly disposed in the positioning trough with both ends of the resistance oil preheating pipe electrically connected to a power source and the inlet of the oil gasifying pipe communicatively connected to a kerosene source and the outlet to an oil sprayer provided under the bottom side of the gasifying body structure. The combustion device includes: a combustor body formed with an arcuate disc member, an oil-gas jet column extending upward in the center of the disc member, a plurality of blow-back holes located around an outer surface away from the oil-gas jet column, and a hollow disc mounting case having a plurality of vent holes formed along a middle portion thereof provided around the periphery of the arcuate disc member; a reflection cover disposed over the disc member around the oil-gas jet column; and a concentrating radiation cover with a multiplicity of oil-gas escape orifices fixed on the disc member over the reflection cover. The assembled combustion device is scarfingly connected to the gasifying device around the external side wall of the latter without welding so as to facilitate maintenance and repair operations therewith.

Other advantage and characteristics of this invention will become clear from the following description of a preferred embodiment when read in conjunction with the accompanying drawings.

BRIEF DESCRIPTION OF THE PREFERRED EMBODIMENT

DETAILED DESCRIPTION OF THE PREFERRED EMBODIMENT

Figure 1:
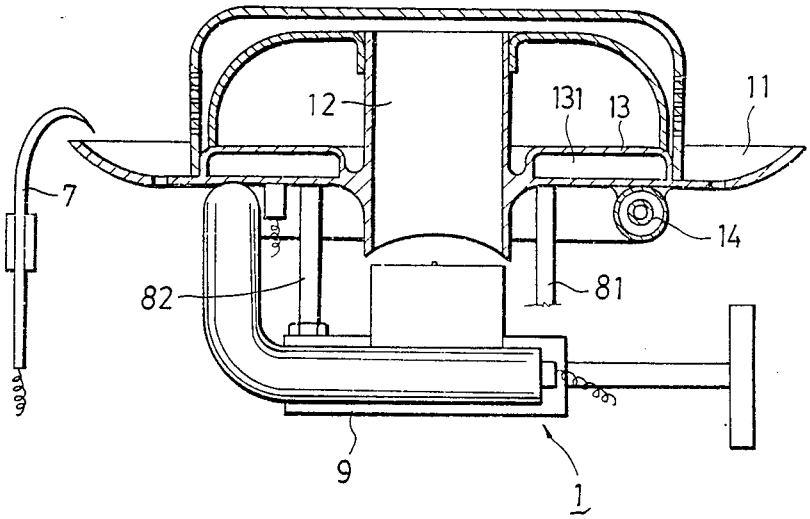
FIG. 1 (PRIOR ART)
FIG. 1 is a partial sectional view of a known kerosene combustor.
Figure 2:
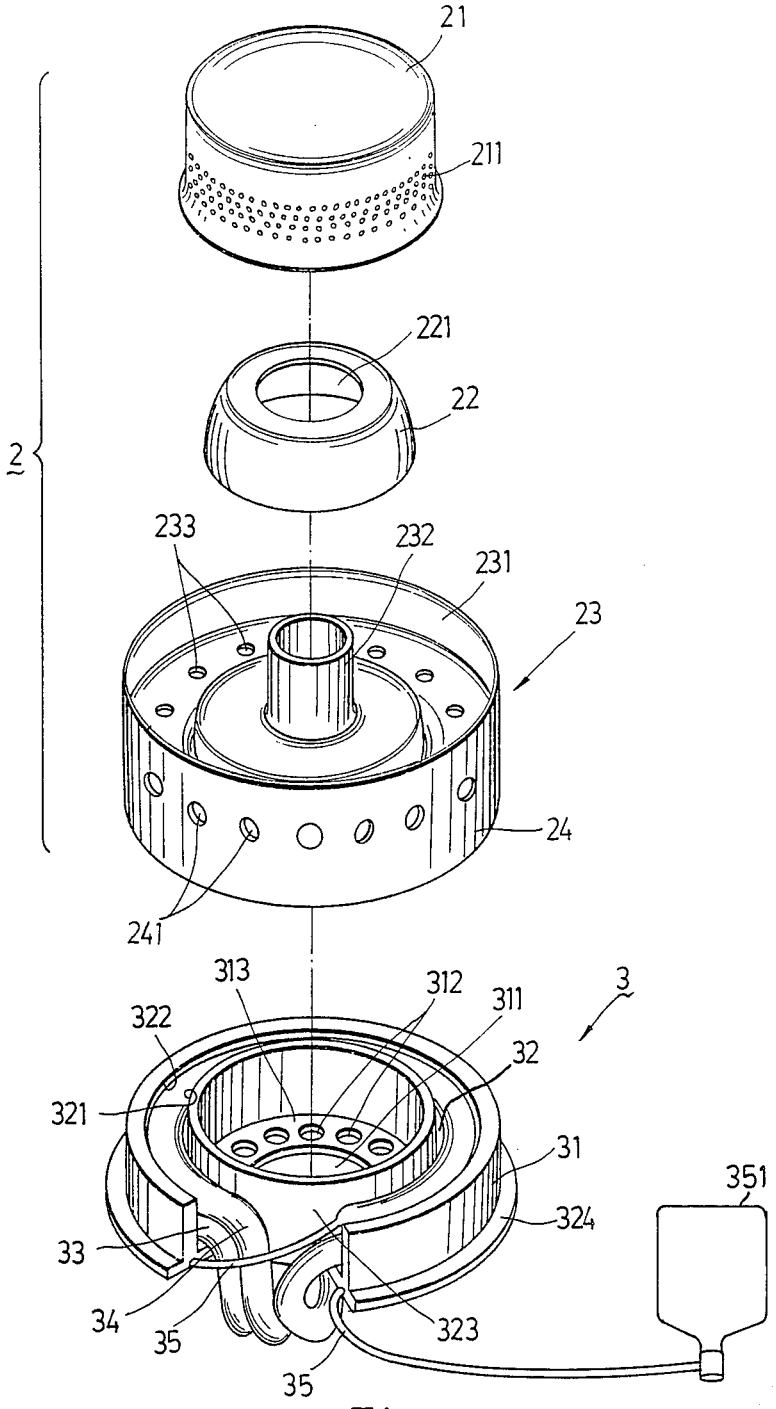
FIG. 2 is an exploded perspective view of a preferred embodiment of a separable type of a kerosene gasifying and combusting apparatus according to this invention.
Figure 3:
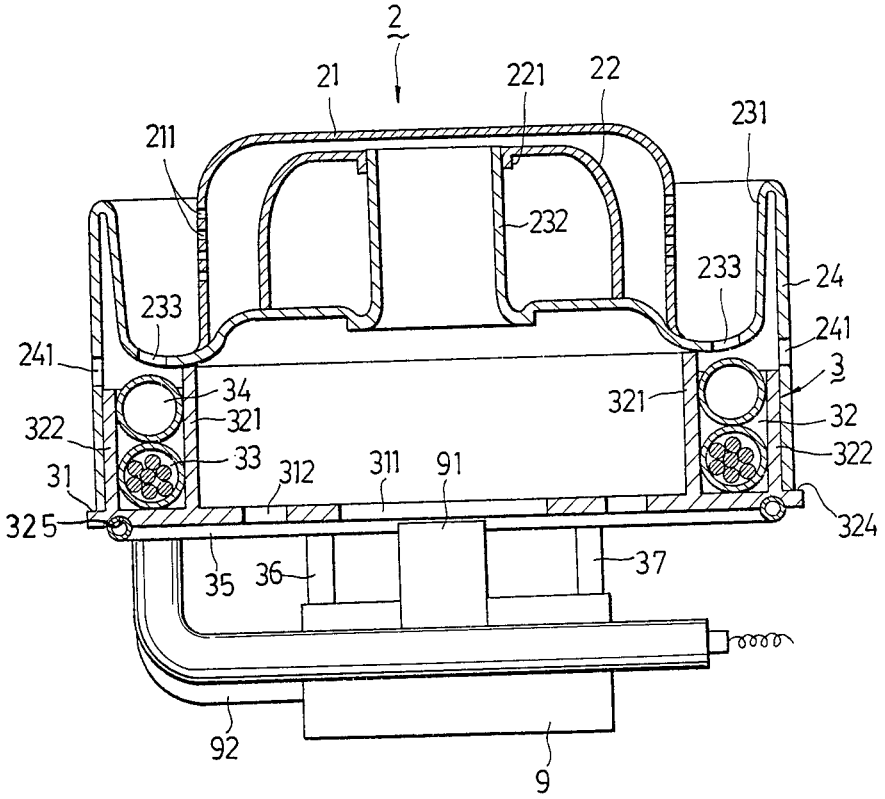
FIG. 3 is a cross-sectional view of the preferred embodiment in assembled condition.

Referring to FIGS. 2 and 3, the preferred embodiment of a separable type of a kerosene gasifying and combusting apparatus according to this invention comprises a separable structure mainly composed of combustion device 2 and a gasifying device 3.

The gasifying device 3 includes a gasifying body structure 31 made of a kind of material with good thermal conductivity, such as copper plate, and formed with a spraying opening 311 in the lower center thereof for permitting the gasified kerosene to be sprayed into the gasifying body structure 31, a plurality of air vents 312 evenly located in a flange surface 313 defining the spraying opening 311, and a positioning trough 32 defined by an internal side wall 321 vertically extending from the flange surface 313 and an external side wall 322, which is vertically formed as an outside frame of the gasifying device 3 with a side opening 323 and a lower outward flange 324 for facilitating assembly and disassembly operations with the combustion device 2. A resistance preheating pipe 33 with heating element provided therein and an oil gasifying pipe 34 are superimposedly disposed (by welding through a kind of welding material with good thermal conductivity such as silver welding rod) in the positioning trough 32 with the upper surface of the oil gasifying pipe 34 barely exposing on a top area within the positioning trough 32 wherein both ends of the heating element of the resistance preheating pipe 33 are electrically connected to an electrical power source (not shown) through a switch (not shown). In addition, the inlet of the oil-gasifying pipe 34 is communicatively connected to an outlet of an oil preheating pipe 35, which is installed in a circular groove 325, as shown in FIG. 3, provided on the bottom side surface of the gasifying body structure 31.

The combustion device 2 includes: a combustion body 23 formed with an arcuate disc member 231, an oil-gas jet column 232 extending upward in the center of the disc member 231, a plurality of blow-back holes 233 evenly located in an outer surface around the oil-gas jet column 232, and a hollow disc mounting case 24 with an inner periphery corresponding to the external side wall 322 of the gasifying body structure 31 and having a plurality of vent holes 241 uniformly located along a wall portion of the mounting case 24 provided around the peripery of the arcuate disc member 231 of which the location of the bottom surface corresponds to the height of the internal side wall 321 of the gasifying body structure 31; a reflection cover 22 having a locating opening 221 formed in the center thereof disposed over the disc member 231 with the oil-gas jet column 232 fittingly received in the locating opening 221; and a concentrating radiation cover 21 with a multiplicity of oil-gas escape orifices 211 fixed on the outer side of the disc member 231 over the reflection cover 22.

The assembled combustion device 2, as shown in FIGS. 2 and 3, is scarfingly coupled with the gasifying device 3 along the positioning trough 32 with the upper end of the internal side wall 321 closely abuting on the bottom side of the disc member 231 and the lower end of the disc mounting case 24 fittingly located on the outward flange 324. It is to be noted that after the coupling of the combustion device 2 and the gasifying device 3, as can be seen in FIG. 3, the blow-back holes 233 of the disc member 231 are situated along the outer side of the internal side wall 322 while the vent holes 241 of the disc mounting case 24 are located above the upper end of the external side wall 322. In addition, the upper surface of the oil gasifying pipe 34 barely exposed in the positioning trough 32 is located below the blow-back holes 233 of the arcuate disc member 231.

Referring to FIG. 2, the inlet of the oil preheating pipe 35 is communicatively connected to an outlet of the kerosene supply source 351 while the outlet is linked to the inlet of the oil gasifying pipe 34 of which the oulet is communicatively connected to an oil sprayer 9 through an oil-gas duct 92. As can be seen in FIG. 3, the spraying opening 311 of the gasifying body structure 31 is in line with the oil-gas jet column 232 of the combustion device 2, and the oil sprayer 9 is located under the bottom side of the gasifying device 3 and connected thereto through a plurality of bracing struts 36, 37 with an oil nozzle 91 of the oil sprayer 9 pointing to the hollow section of the spraying opening 311 and the oil-gas jet column 232 so as to spray the gasified kerosene in perpendicular direction therewith. In addition, a portion of the resistance preheating pipe 33 extending out of the positioning trough 32 is installed under the bottom of the gasifying device 3, preferably being kept in contact with the oil sprayer 9.

Operations and features of the preferred embodiment according to this invention are as follows:

Before ignition, the resistance preheating element 33 is preheated by turning on the electric power (not shown) electrically connected thereto. In this condition, the temperature of both the gasifying body structure 31 and the oil sprayer 9 will be raised, and, at the same time, the kerosene delivered from the kerosene source under a certain pressure is first preheated through the oil preheating pipe 35 (the thermal power for this preheating action is coming from the gasifying body structure) for increasing the kerosene temperature before being fed into the oil gasifying pipe 34 so as to expedite the gasifying action of the kerosene therein. After that, when the gasified kerosene is being delivered to the oil sprayer 9 through the duct 92, heating action is continuously provided by the resistance preheating element 33 for keeping the kerosene in a completely gasified state. The gasified kerosene is then sprayed upward from the oil nozzle 91, passing through the hollow space of the oil-gas jet column 223 and the space between the reflection cover 22 and the radiation cover 21, and being spread out from the oil-gas escape orifices 211 for being ignited thereat by a proper spark ignitor (not shown) provided thereto (since the spark ignitor is a well known art, illustration and description are hereby omitted for clarity). The ignited flame combusting over the disc member 231 within the combustor body 23 and the outer area of the concentrating radiation cover 21 can be utilized as follows:

(1) In addition to the main flame (it can be used for domestic applications such as cooking) a portion of the flame from the combustion in the combustor body 23 will burn downward from the disc member 231 through the blow-back holes 233, directly heating the barely exposed part of the oil gasifying pipe 34 in the positioning trough 32 so as to provide a heat source required to gasify the kerosene in the oil gasifying pipe 34; wherein, the air required for the blow-back flame is supplied from the vent holes 241 of the disc mounting case 24. On the other hand, the blow-back flame is isolated by the internal side wall 321 and confined only in the space over the positioning trough without producing combustion within the area defined by the internal side wall 321 nor causing side current of air therein so that the kerosene coming out of the oil nozzle 91 can be completely (100%) sprayed upward into the combustion device 2 without suffering disturbed air stream. During the time the gasifyied kerosene is being sprayed upward from the oil nozzle 91, stable air is supplied from the air vent 312 of the gasifying body structure 31 for being mixed with the gasified kerosene.

(2) By contact conduction, the high temperature of heat produced by the combustor body 24 of the combustion device 2 and transferred to the positioning trough 32, together with the high temperature of heat of the external side wall 322 as well as the internal side wall 321 of the gasifying device 3, will be transferred to the oil sprayer 9 through the bracing struts 36, 37, which are made of a kind of material with good thermal conductivity. Therfore, after the resistance preheating element 33 is turned off, the kerosene within the oil preheating pipe 35 can be continuously preheated and also continuously gasified in the oil gasifying pipe 34 and the oil preheating pipe 35, and when the gasified kerosene is being fed into the oil sprayer 9 through the oil-gas duct 92, heat is continuously applied to the gasified kerosene so as to maintain it in a perfect gasified condition.

The preferred embodiment of this invention resides in the following features:

(1) Since the connection made between the combustion device 2 and the gasifying device 3 is not done by welding, poor combustion efficiency and accidental risky situation as suffered by the associated prior art are completely obviated.

(2) With a separable structure of the combustion device and the gasifying device, maintenance and repair (usually required for the oil nozzle 91 of the oil sprayer 9) can be conventiently performed as the situation dictates.

(3) In the preferred embodiment, kerosene heating and gasifying processes performed whether by the resistance preheating element 33 or by the local thermal energy of combustion flame, including the blow-back flame, are effectively utilized. In addition, no air disturbance occurs in the oil-gas jetting cource so that combustion efficiency is greatly increased.

It will be appreciated, of cource, that although a particular embodiment of the invention has been shown and described, modifications may be made. It is intended in the following claims to cover all modifications which fall within the scope of the invention.

What is claimed is:

1. A kerosene gasifying and combusting apparatus comprising:

a gasifying means having a body structure of material with good thermal conductivity and including a spraying opening formed centrally in a lower portion of the body structure, a plurality of air vents evenly spaced in a flange surface of said body structure defining said spraying opening, and a positioning trough defined by an internal side wall vertically extending from said flange surface and an external side wall with a side opening and a lower outward flange thereof surrounding said internal side wall and serving as an outer portion of said body structure, for facilitating kerosene gasifying operations therewith;

a plurality of vertical bracing struts each fixed at one end thereof on a bottom side of the body structure of said gasifying means and each connected at another end thereof with an oil sprayer having an oil nozzle uprightly aligned with said spraying opening of said body structure for spraying gasified kerosene therefrom:

a resistance preheating means disposed in said positioning trough for kerosene preheating operation;

an oil-gasifying means superimposedly arranged over said resistance preheating means in said positioning trough and fixed in thermally conductive contact therewith, with an inlet of said oil-gasifying means being adapted to be communicatively connected to a kerosene supply source and with an outlet of said oil-gasifying means communicatively connected to the oil sprayer, for providing heated and gasified kerosene therewith; and a combustion means having a plurality of combusting and covering members detachably assembled together and including a mounting case, and adapted to be scarfingly coupled by the mounting case thereof with the body structure of said gasifying means along the external side wall and the positioning trough thereof, for effecting gasified combustion;

whereby, when the combustion means is scarfingly coupled with the gasifying means, combustion heat from the combustion means is transferred to the positioning trough of the gasifying means for promoting gasification of kerosene in the oil-gasifying means, and the combustion means and gasifying means can be scarfingly uncoupled from one another for facilitating maintenance thereof.

2. A kerosene gasifying and combusting appatatus as claimed in claim 1 wherein said combustion means comprises:

a combustion body having an arcuate disc member formed in a middle portion with an oil-gas jet column extending upward in a central area of the disc member, a plurality of blow-back holes evenly provided in an outer surface of the disc member, and a hollow disc mounting case with an inner pheriphery corresponding to the external side wall of said gasifying means and a plurality of vent holes uniformly located along a middle area of the disc mounting case formed around a periphery of the arcuate disc member so as to have its bottom closely engaged with a top surface of the internal side wall and its inner periphery with the external side wall of said gasifying means on being scarfingly coupled therewith;

a reflection means having a locating opening formed in a center thereof covered around said oil-gas jet column over the arcuate disc member for shielding the oil-gas jet column from said blow-back holes; and a concentrating radiation covering means having a multiplicity of oil-gas escape orifices formed around its circumferential surface fixed on an outer side of said arcuate disc member over said reflection means so as to encase said blow-back holes therein and confine the combustion within its covered area; thereby, in addition to the main combustion after ignition, a portion of a flame will be burnt downward to said gasifying body sturture through said blow-back holes of said arcuate disc member for heating purpose without requireing continuous heating operation from said resistance preheating pipe.

3. A kerosene gasifying and combusting apparatus as claimed in claim 1 wherein said oil gasifying means comprises: an oil preheating pipe disposed in a circular groove provided in a bottom side of the body structure of said gasifying means with an inlet of said oil preheating pipe communicatively connected to the kerosene source; and an oil gasifying pipe, having its inlet communicatively connected to an outlet of said oil preheating pipe and its outlet connected to the oil sprayer, fixedly disposed in said positioning trough over said resistance preheating means so that kerosene preheating and gasification can be effectively achieved therewith.

4. A kerosene gasifying and combusting apparatus as claimed in claim 2 wherein said arcuate disc member includes a bottom portion formed in conjunction with the internal side wall so that when said combustion means is coupled with said gasifying means, the bottom portion of said arcuate disc member is closely engaged with the top surface of said internal side wall so as to enable the spraying opening defined within said internal side wall to be completely isolated from the combustion flame burning downward through the blow-back holes of said arcuate disc member.

5. A kerosene gasifying and combusting apparatus as claimed in claim 2 wherein the wall portion of said hollow disc mounting case is formed in accordance with said external side wall and said outward flange thereof so that when said combustion means is scarfingly coupled with said gasifying means, a lower end of the wall portion of said hollow disc mounting case is closely abutted on said outward flange with a top end portion of said external side wall located below the vent holes of the wall portion of said disc mounting case so as to supply the required air for the combustion flame burning downward from the blow-back holes of said arcuate disc member.

6. A kerosene gasifying and combusting apparatus as claimed in claim 1 wherein said bracing struts are made of material with good heat conductivity so as to facilitate heat transmission from said gasifying means to the oil sprayer.

* * * * *